US008195398B2

(12) United States Patent
Lovell et al.

(10) Patent No.: US 8,195,398 B2
(45) Date of Patent: Jun. 5, 2012

(54) IDENTIFYING TYPES OF SENSORS BASED ON SENSOR MEASUREMENT DATA

(75) Inventors: John R. Lovell, Houston, TX (US); Fitrah Arachman, Bekasi (ID)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/833,515

(22) Filed: Jul. 9, 2010

(65) Prior Publication Data

US 2011/0010096 A1 Jan. 13, 2011

Related U.S. Application Data

(63) Continuation-in-part of application No. 11/768,022, filed on Jun. 25, 2007, now Pat. No. 7,890,273.

(60) Provisional application No. 60/890,630, filed on Feb. 20, 2007, provisional application No. 61/224,547, filed on Jul. 10, 2009.

(51) Int. Cl.
*G01V 9/00* (2006.01)

(52) U.S. Cl. ..... 702/6

(58) Field of Classification Search ..... 702/6–13
See application file for complete search history.

(56) References Cited

U.S. PATENT DOCUMENTS

| | | | | |
|---|---|---|---|---|
| 6,234,257 | B1 | 5/2001 | Ciglenec et al. | |
| 6,588,266 | B2 | 7/2003 | Tubel et al. | |
| 6,671,224 | B1 | 12/2003 | Pabon | |
| 7,277,796 | B2 | 10/2007 | Kuchuk et al. | |
| 7,496,450 | B2 * | 2/2009 | Ortiz Aleman et al. | 702/6 |
| 2007/0227727 | A1 | 10/2007 | Patel et al. | |
| 2008/0201080 | A1 | 8/2008 | Lovell et al. | |
| 2009/0166031 | A1 | 7/2009 | Hernandez | |
| 2010/0018714 | A1 | 1/2010 | Merlau et al. | |

FOREIGN PATENT DOCUMENTS

| | | | |
|---|---|---|---|
| WO | 2009122166 | A2 | 10/2009 |
| WO | 2009122166 | A3 | 10/2009 |

* cited by examiner

*Primary Examiner* — Drew A Dunn
*Assistant Examiner* — Stephen Cherry
(74) *Attorney, Agent, or Firm* — Brandon S. Clark

(57) ABSTRACT

Plural sensors are deployed into a well, and measurement data regarding at least one property of the well is received from the sensors. Based on the measurement data, a first of the plural sensors that measures the at least one property in a region having an annular fluid flow is identified, and a second of the plural sensors that measures the at least one property in a region outside the region having the annular fluid flow is identified. Based on the identifying, the measurement data from selected one or more of the plural sensors is used to produce a target output.

21 Claims, 4 Drawing Sheets

IDENTIFYING TYPES OF SENSORS BASED ON SENSOR MEASUREMENT DATA

CROSS REFERENCE TO RELATED APPLICATIONS

This application claims the benefit under 35 U.S.C. §119 (e) of U.S. Provisional Application Ser. No. 61/224,547 entitled "METHOD AND APPARATUS TO DETERMINE RESERVOIR PROPERTIES AND FLOW PROFILES," filed Jul. 10, 2009, which is hereby incorporated by reference.

This application is a continuation-in-part of U.S. Ser. No. 11/768,022, entitled "DETERMINING FLUID AND/or RESERVOIR INFORMATION USING AN INSTRUMENTED COMPLETION", filed Jun. 25, 2007, which claims the benefit under 35 U.S.C. §119(e) of U.S. Provisional Application No. 60/890,630, entitled "Method and Apparatus to Derive Flow Properties Within a Wellbore," filed Feb. 20, 2007, both hereby incorporated by reference.

BACKGROUND

Sensors can be deployed in wells used for production or injection of fluids. Typically, sensors are placed on the outer surface of completion equipment deployed in a well. As a result, it is typically the case that the sensors are measuring properties of the completion equipment, rather than properties (e.g., temperature) of fluids in an inner bore of the completion equipment. In some situations, the inability to accurately detect properties (e.g., temperature) of fluids in the inner bore of completion equipment may lead to inaccurate results when using the measurement data collected by the sensors.

SUMMARY

In general, according to some embodiments, plural sensors are deployed into a well, and measurement data regarding at least one property of the well is received from the sensors. Based on the measurement data, a first of the plural sensors that measures the at least one property in a region having an annular fluid flow is identified, and a second of the plural sensors that measures the at least one property in a region outside the region having the annular fluid flow is identified. Based on the identifying, the measurement data from selected one or more of the plural sensors is used to produce a target output.

Other or alternative features will become apparent from the following description, from the drawings, and from the claims.

BRIEF DESCRIPTION OF THE DRAWINGS

Some embodiments are described with respect to the following figures.

DETAILED DESCRIPTION

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
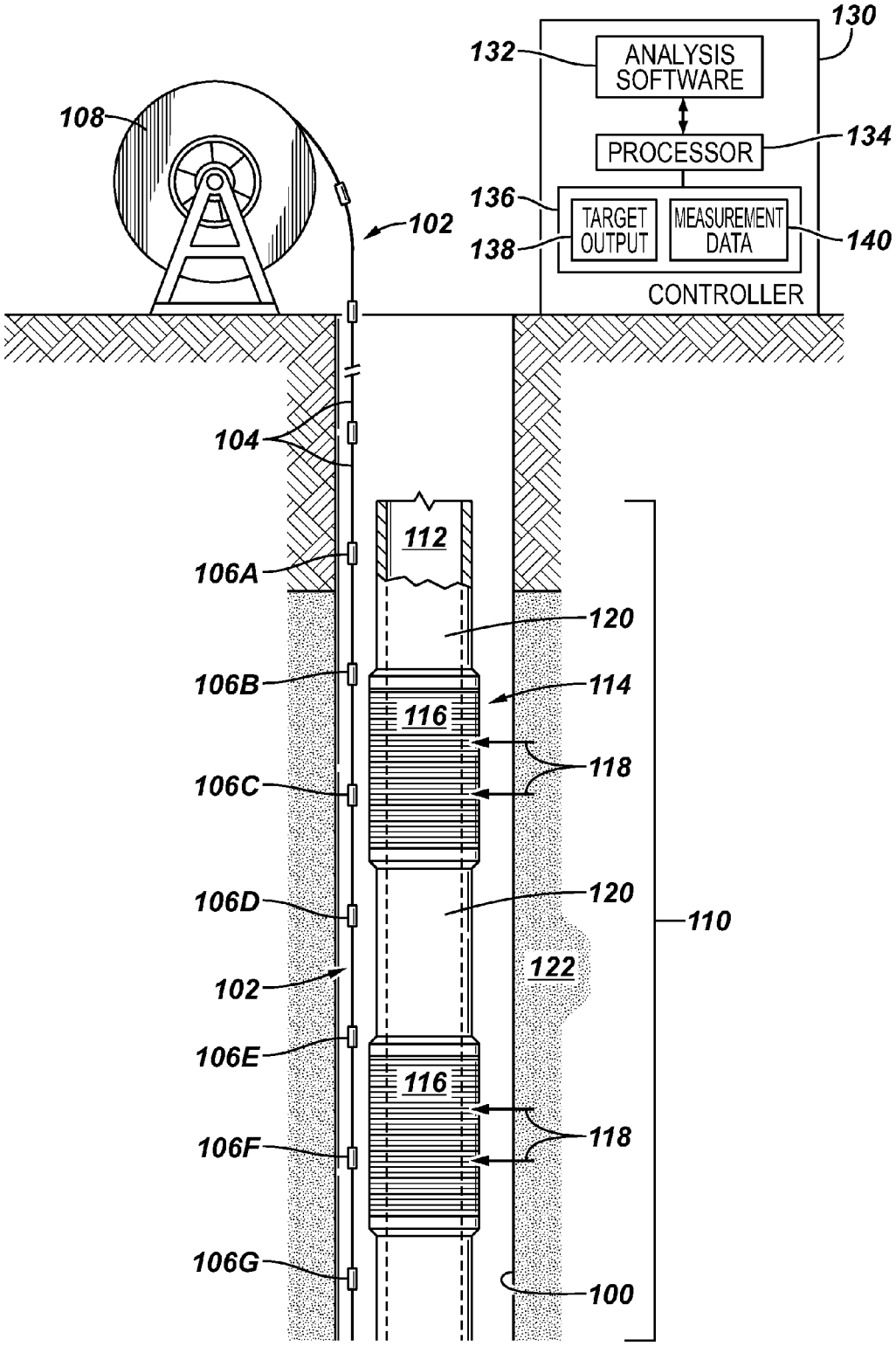
FIG. 1 is a schematic diagram of an example arrangement that includes completion equipment and a controller according to some embodiments.

A spoolable array of sensors can be deployed into a well to measure at least one downhole property associated with the well. A "spoolable array of sensors" refers to a collection of sensors arranged on a carrier structure that can be spooled onto a drum or reel, from which the array of sensors can be unspooled for deployment into a well. As depicted in FIG. 1, a spoolable array 102 of sensors is depicted as being deployed in a well 100. This spoolable array 102 of sensors has a carrier structure 104 that carries sensors 106 (106A-106G labeled in FIG. 1). In some implementations, the sensors 106 are temperature sensors for measuring temperature. In other implementations, the sensors 106 can be other types of sensors for measuring other downhole properties in the well 100. As yet further implementations, there can be different types of sensors 106 in the array 102 of sensors.

As further depicted in FIG. 1, the spoolable array 102 of sensors can be unspooled from a drum or reel 108. To deploy the spoolable array 102 of sensors, the drum or reel 108 is rotated to allow the spoolable array 102 of sensors to be lowered into the well 100. A benefit of using the spoolable array 102 of sensors is ease of deployment. Moreover, the spoolable array 102 of sensors can be deployed outside of completion equipment (generally referred to as 110 in FIG. 1), such that the array 102 of sensors is not provided in the inner bore 112 of the completion equipment 110 and thus does not impede access for other types of tools, including workover tools, logging tools, and so forth.

Although reference is made to a spoolable array of sensors, it is noted that in other implementations, multiple sensors can be deployed into a well without being part of a spoolable array.

An issue associated with using the arrangement of FIG. 1, in which sensors 106 are deployed on the outer surface of the completion equipment 110, is that the sensors 106 are measuring downhole property(ies) of the completion equipment 110, rather than property(ies) of fluid inside the inner bore 112 of the completion equipment 110.

In the example shown in FIG. 1, the completion equipment 110 includes sand control assemblies 114 that each has a corresponding screen section 116. The screen section 116 is used to keep out particulates that may be present in the well 100 from entering into the inner bore 112 of the completion equipment 110. As depicted by arrows 118 in FIG. 1, the sand control assemblies 114 allow for annular fluid flow from a region of the well 100 outside the completion equipment 110 into the inner bore 112 of the completion equipment 110. Each region of the well 100 in which an annular fluid flow exists is referred to as an annular fluid flow region.

The completion equipment 110 also includes blank sections 120 adjacent the screen sections 116, where the blank sections 120 can be implemented with blank pipes, for example. The region of the well 100 surrounding each blank section 120 is not subjected to annular fluid flow as represented by arrows 118.

The sensors 106 that are in regions outside the annular fluid flow regions can provide a relatively good approximation of a property (e.g., temperature) of fluid flowing in the inner bore 112 of the completion equipment 110. Such regions that are outside the annular fluid flow regions are referred to as "well regions," and sensors (e.g., 106A, 106B, 106C, 106E, 106G)

in such well regions are used for measuring "well properties." In contrast, sensors (e.g., 106D, 106F) that are in the annular fluid flow regions measure at least one property associated with the annular fluid flow that directly impinges on such sensors. These sensors that are in the annular fluid flow regions do not accurately measure property(ies) of the fluid flowing inside the inner bore 112 of the completion equipment 110.

Note that the fluids that can flow in the inner bore 112 of the completion equipment 110 can include gas and/or liquids. Although FIG. 1 depicts a flow of fluid in a production context, where fluids are produced from a reservoir 122 surrounding the well 100 into the inner bore 112 of the completion equipment 110 for production to the earth surface, it is noted that in alternative implementations, the completion equipment 110 can be used for injecting fluids through the completion equipment 110 into the surrounding reservoir 122.

The arrangement of components of the example completion equipment 110 shown in FIG. 1 is provided for purposes of example. In other implementations, other assemblies of components can be used in completion equipment.

FIG. 1 also shows a controller 130, which can be deployed at the well site, or alternatively, can be deployed at a remote location that is relatively far away from the well site. The controller 130 can be used to analyze the measurement data collected from the sensors 106 of the spoolable array 102 of sensors. The controller 130 has analysis software 132 executable on a processor 134 (or multiple processors 134). The processor(s) 134 is (are) connected to storage media 136, which can be used to store measurement data 140 from the sensors 106. Also, the analysis software 132 can produce target output 138 that is stored in the storage media 136. As discussed further below, the target output 138 can be generated by the analysis software 132 based on measurement data from selected one or more of the sensors 106.

The analysis software 132 according to some embodiments is able to distinguish between sensors that are measuring well properties (sensors 106 in well regions outside the annular fluid flow regions) and those sensors that are measuring properties of annular fluid flow (in the annular fluid flow regions). In some cases, the analysis software 132 can also identify sensors that are measuring a combination of properties of annular fluid flow and non-annular fluid flow. The analysis software 132 can either directly perform the distinction between the different types of sensors (sensors in well regions, sensors in annular flow regions, or sensors measuring property(ies) of a combination of annular flow and non-annular flow), or alternatively, the analysis software 132 can present information to a user at the controller 130 to allow the user to identify the different types of sensors. Thus, the analysis software 132 distinguishing between the different types of sensors can refer to the analysis software 132 making a direct distinction, or alternatively, the analysis software 132 can perform the distinguishing by presenting information to user and receiving feedback response from the user.

The target output 138 can be one of various types of outputs. For example, the target output 138 can be a model for predicting a property (e.g., temperature, flow rate, etc.) of the well 100. This model can be adjusted based on measurement data from selected one or more of the sensors 106 to provide for a more accurate model from which predictions can be made. In alternative implementations, the target output 138 can be a flow profile along the well 100 that represents estimated flow rates along the well 100, where the estimated flow rates can be based on the measurement data (e.g., temperature measurement data) from selected one or more of the sensors 106.

Other examples of the target output 138 include estimated reservoir properties near the well (such as permeability and porosity), and/or estimated properties regarding the reservoir such as connectivity and continuity.

Adjustment of a model can refer to adjustment of various parameters used by the model, such as reservoir permeabilities, porosities, pressures, and so forth. Other parameters of a model can include thermal properties of completion equipment in the well. By varying the various parameters associated with the model, an optimal fit between predicted data as produced by the model and measured data from selected one or more of the sensors 106 can be achieved, which results in a more accurate model. For example, the fit between predicted data from the model and measured data can be a fit between predicted data from the model and measurement data of sensors that are in well regions that are outside the annular fluid flow regions.

Although the array 102 of sensors is deployed in one well 100 in FIG. 1, it is noted that multiple arrays 102 of sensors can be deployed in multiple wells. The techniques discussed above can then be performed for each of such multiple wells individually, or for the multiple wells simultaneously, to allow for a determination of information about well properties in the wells.

By using measurement data from selected one or more of the sensors 106 to produce the target output 138, expensive and time-consuming intervention tools do not have to be deployed into the well 100 to collect measurement data for producing the target output 138. The spoolable array 102 of sensors can be deployed while the well 100 is being completed. As a result, the sensors 106 can provide data over the life of the well. Therefore, by using techniques according to some embodiments, fewer interventions would have to be performed to monitor and evaluate characteristics of the well, which can result in reduced costs.

Consider for example, the use of passive temperature sensors such as resistive temperature devices that are mounted on a sand screen. The sand screen may be divided into flowing and non-flowing intervals. In the context of FIG. 1, the non-flowing intervals would correspond to the blank sections 120, and the flowing intervals would be adjacent the screen sections 116. Suppose that a mass flow amount dW flows through the sand screen over a particular interval dz. By construction, dW approaches or equals zero (0) over some other sections of the screen. Over other sections, dW will be non-zero. Integration of dW will give the total flow in the well, W, at any depth z. The velocity of the flow is given by V=W/(A rho) where A is the area of the pipe and rho the fluid density, e.g., A=pia^2 for a cylindrical pipe of radius a.

Assume that the incoming annular fluid has a temperature Tf(z) and the well fluid has a temperature T(z). In many situations, these two temperatures will not be the same. For example, assuming a geothermal temperature gradient along the well, the fluid that entered at the lower sections of the well will be relatively warmer as it flows up to higher sections of the well. Pressure drops across a sandface will also cause changes in temperature due to Joule-Thompson effects.

Because of those temperature differences, the well fluid will lose some heat to a surrounding reservoir (or gain if for some reason the well fluid is colder, as would happen during an injection process). A reasonable approximation can assume that the amount of heat lost will be a function of the well fluid temperature T(z) and the reservoir temperature Tr(z). The steady-state heat flow per unit length out of the well through casing and into a reservoir having temperature Tr(z) may be modeled by k(T(z), Tr(z)). When Joule-Thompson effects are small, then Tf(z) and Tr(z) can be close. More commonly they will differ by a few degrees.

Balancing the heat across a section dz produces the following:

$$(W+dW)*(T+dT)-W*T=Tf*dW-k(T,Tr)*dz$$

$$\text{i.e.,}\ W*dT/dz+T*dW/dz=Tf*dW/dz-k(T,Tr).$$

This equation represents a foundation equation for distributed temperature monitoring. A typical formulation for k is that k(T,Tr) is proportional to T−Tr.

Figure 2:
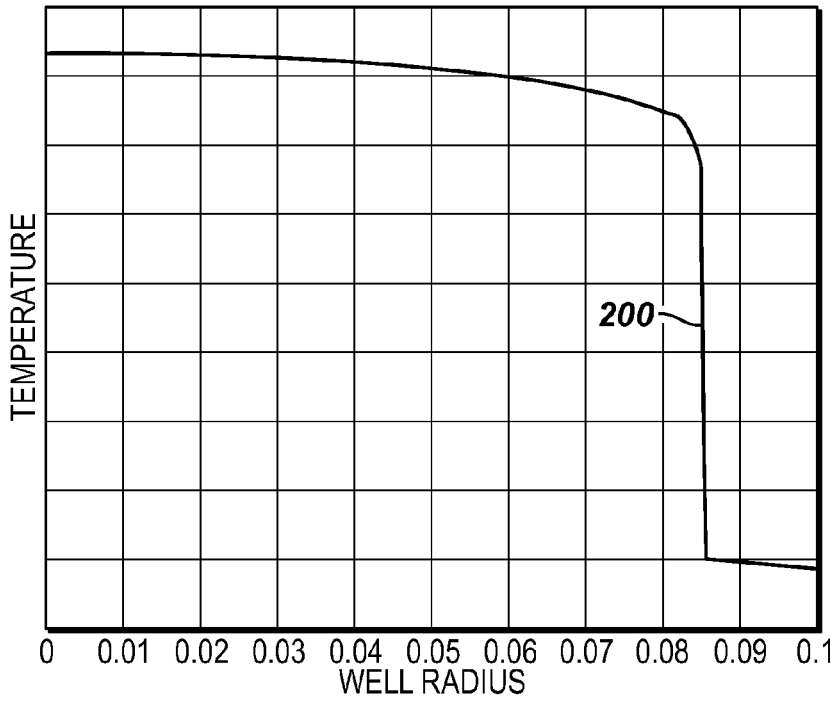
FIGS. 2-6 are graphs illustrating responses of sensors that are to be used according to some embodiments.

However, there is a significant restriction assumed by the equations, which is that T(z) is the average well temperature. Measuring the average well temperature requires sensors disposed inside of the well. Sensors outside of the well are affected by the well temperature, but the relationship is one which requires computation and correction. For example, consider FIG. 2 for a high-rate gas producing well. FIG. 2 depicts a graph 200 representing temperature versus radius in a high-rate flowing gas well. The graph 200 demonstrates that a sensor measuring either the inside or the outside of the completion equipment 110 will have a small offset compared to T(z). In the example of FIG. 2, the temperature along the well axis is 400.017 K (kelvin), which is more or less constant across the well radius and then drops rapidly to 399.65 K just inside of the completion equipment 110. The temperature across the completion equipment (from r=0.085 m to r=0.1 m in the example) is more or less constant. The temperature measurement of a deployed sensor placed at r=0.1 m could be reasonably inferred to be measuring the temperature of the inner completion at r=0.085 m. Algorithms exist to determine the average fluid temperature once the temperature if the inner bounding surface is known. For example, as disclosed in "Convective Heat and Mass Transfer" by W. Kays, M. Crawford and B. Weigand (McGraw Hill, 2005), the difference between the mean fluid temperature T and the surface temperature Ts is given by Ts−T=q/h where h is a heat transfer coefficient and q is the heat flux, q=k(T,Tr)/(2 pi a C_p) where C_p is the fluid heat capacity. Moreover expressions for the heat transfer coefficient exist, for example, for laminar flow h=4.364 k/(2 a), where k is the fluid thermal conductivity (which can be measured at surface). More complicated expressions can be derived when the completion is a combination structure such as a metal cylinder inside a cement sheath inside the reservoir. Heat transfer coefficients for such assemblies are given, for example, in "Ramey's Wellbore Heat Transmission Revisited", by J. Hagoort, in SPE Journal, Vol 9, No 4, 2004, the entire contents of which are incorporated by reference. The derivation of the flow profile can be assisted by a reservoir model to derive the fluid temperature from the reservoir temperature, as detailed in "Well Characterization Method" by S. Kimminau et al, US Patent Publication No. 2008/0120036 and "Combining Reservoir Modelling with Downhole Sensors and Inductive Coupling", by S. Kimminau, G. Brown and J. Lovell, US Patent Publication No. 2009/0182509, the contents of both of which are herein incorporated by reference.

The situation is more complicated when a sensor is subjected to the direct impact of an incoming annular fluid flow. In this scenario, the sensor will not be able to directly measure the average well temperature, and the sensor will also be affected by the temperature of the surrounding fluid. One proposal for avoiding this type of situation is to specifically make temperature measurements away from any incoming annular fluid flow, for example, by placing the sensors on the parts of the completion equipment that do not provide ingress into the well, such as on the sections of blank sections between screens, as has been disclosed by US Patent Publication No. 2008/0201080, "Determining Fluid and/or Reservoir Information Using An Instrumented Completion" by J. Lovell, et al, the contents of which are herein incorporated by reference. "Method for Determining Reservoir Properties in a Flowing Well" by G. Brown, US Patent Publication No. 2010/0163223, has disclosed the use of optical sensors which are deployed at some distance from the exterior of a completion.

However, for ease of manufacturing, the array 102 of sensors as depicted in FIG. 1 is typically constructed with sensors 106 that are uniformly spaced apart. When the sensor array 102 is attached to the completion equipment 110, the general location of the sensors with respect to the reservoir will be difficult to predict in advance. It may be possible to build a non-uniform array of sensors based upon the anticipated reservoir properties, but since the manner of conveyance is imprecise (e.g., the sand screen may not make it all the way to the bottom of the well because of friction, debris, etc), the predetermined arranged placements of sensors may not prove be valid was the assembly is deployed. Communication and grounding of the sensors may also impose limitations on sensor positioning.

To alleviate the issues associated with precise positioning of sensors in a well, techniques according to some embodiments are provided. Measurement data from the sensors themselves can be used for identifying which sensors is (are) measuring well temperature (in well regions outside annular fluid flow regions) and which sensors is (are) in annular fluid flow regions. One observation is that small objects have a relatively fast temperature response to temperature changes whereas large objects have a relatively slower response. In the context discussed above, there should be a relatively rapid temperature response by those sensors that are measuring annular fluid impingement (a local phenomenon) and a slow temperature response by those sensors that are measuring the well temperature (a large "object" whose temperature is a weighted average of all the axially flowing fluids from lower sections of a well).

Temperature changes occur downhole for a variety of reasons, but during the normal operation of a well, temperature changes are typically produced at different rates, especially when first cleaning up the well. Consequently, given real-time or recorded well data, one can search for pressure events and look at the corresponding temperature events. The relationship of temperature events to pressure events for measurement data collected by a sensor is one example of a "profile" of a sensor. This profile of the sensor can be analyzed for determining whether the sensor is in a well region outside an annular fluid flow region or whether the sensor is in an annular flow region.

Figure 3:
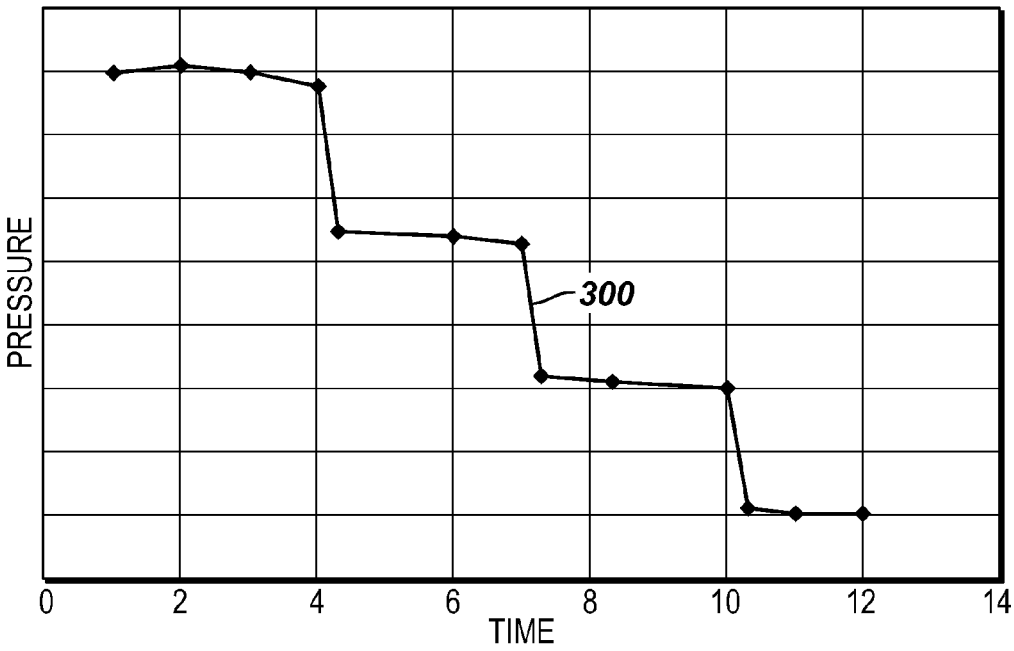

Pressure data is ideally measured downhole with permanent gauges, but can also be determined by measuring wellhead pressure. A typical pressure trace is shown in FIG. 3, in this case the well is being gradually opened, so the downhole pressure is decreasing. FIG. 3 shows a graph 300 that represents temperature measured by a sensor as a function of pressure.

In general, pressure changes are rapidly distributed along the well with minimal time delay (e.g., such as at the speed of sound) from one pressure gauge to another one in the well. The corresponding change on a temperature sensor depends on how well that sensor is coupled to the well.

Figure 4:
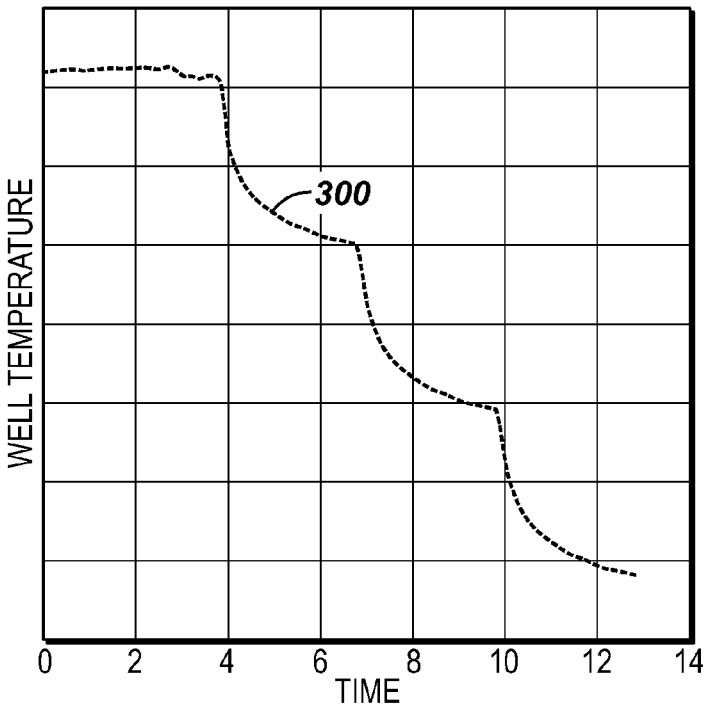

Referring to FIG. 4, a graph 400 represents the temperature response of a sensor as a function of pressure in a well that is producing gas. In this example, the produced fluid will become colder with each pressure change: as the pressure drawdown increases, and the Joule-Thomson coefficient is negative, the temperature drops. The example shown in FIG. 4 is of a sensor located in a well region outside an annular fluid flow region.

Figure 5:
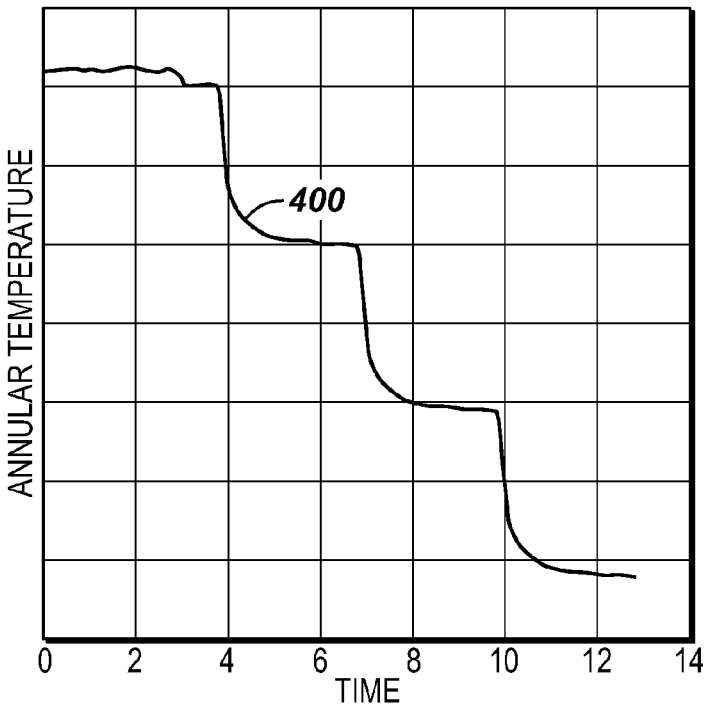
Figure 6:
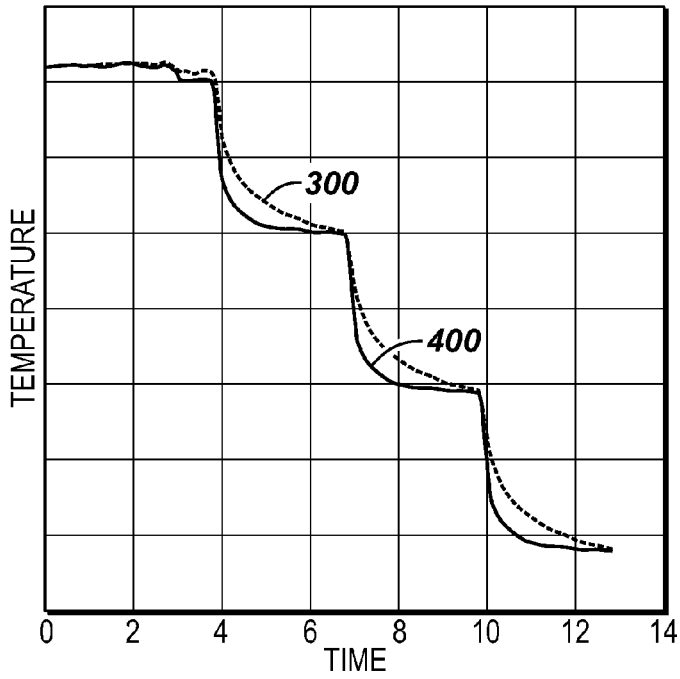

The FIG. 4 response may be compared to the response shown in FIG. 5, which depicts a graph 500 representing the temperature response of a sensor as a function of pressure, where the sensor is in an annular fluid flow region. As can be seen, the temperature response of the sensor that is subjected to direct gas impingement is much more rapid. This is more clearly shown in FIG. 6, in which the data for both sensors (represented in FIGS. 4 and 5) are superimposed. The results may be generalized to classify each sensor in an array. For example, if a sensor in the array has a response matching the profile represented by graph 400, then the sensor may be classified as measuring a well property. Alternatively, if a sensor in the array has a response matching the profile represented by graph 500, then the sensor is classified as measuring a property of annular fluid flow.

Figure 7:
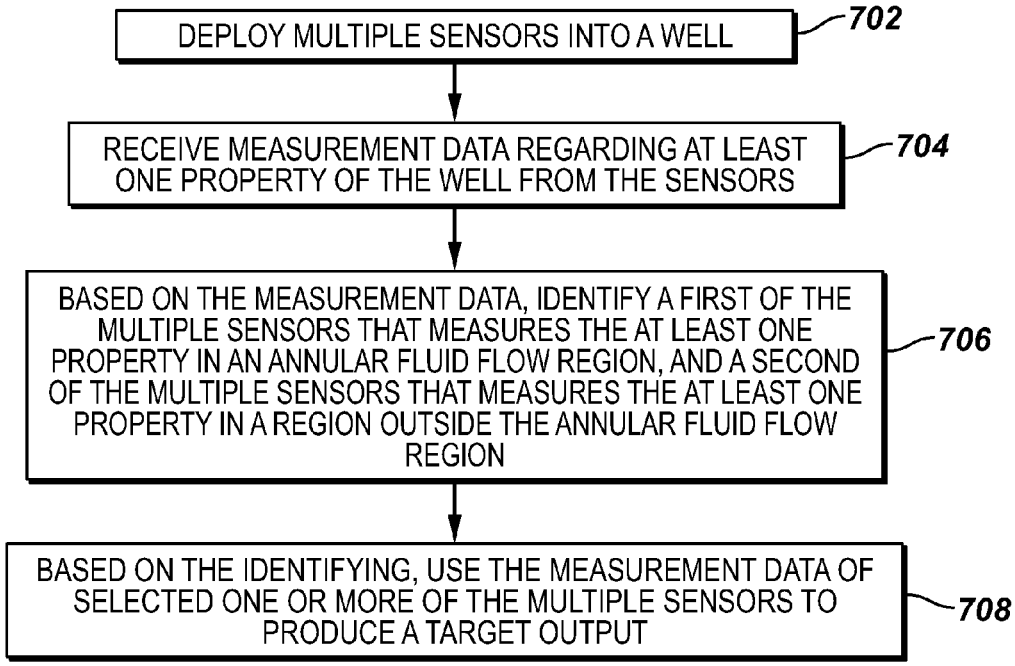
FIG. 7 is a flow diagram of a process according to some embodiments.

FIG. 7 is a flow diagram of a process according to some embodiments. Multiple sensors are deployed (at 702) into a well, such as the multiple sensors 106 in the spoolable array 102 depicted in FIG. 1. After deployment of the sensors, measurement data regarding at least one property of the well is received (at 704) from the sensors. In some examples, the at least one property can be temperature. In other examples, other downhole properties in the well (e.g., pressure, flow rate, etc.) can be measured by the sensors.

Based on the measurement data, a first of the multiple sensors that measures the at least one property in an annular fluid flow region is identified (at 706). Similarly, based on the measurement data, a second of the multiple sensors that measures the at least one property in a region outside the annular fluid flow region is identified (at 706). Note that there can be multiple first sensors and multiple second sensors identified. The identification of first and second sensors is based on comparing the response of each of the sensors with corresponding profiles that indicate whether a sensor is in an annular fluid flow region or in a well region outside an annular fluid flow region.

Based on the identifying, the measurement data of selected one or more of the multiple sensors can be used (at 708) to produce a target output. For example, the selected one or more sensors can be the identified second sensor(s) that measure(s) the at least one property in a region outside the annular fluid flow region. The target output can be a model used for predicting a property of the well. Alternatively, the target output can be a flow profile along the well, or any other characteristic of the well.

In alternative implementations, more quantitative techniques may also be used to define and classify sensors. For example, a first response (y) can be an affine transform (e.g., y=Ax+B) of the another response (x). Assuming this, it is then a straightforward procedure with a graphical program to move one curve relative to the other and check for a match, simply by drawing the two curves with respect to different axes and adjusting the minimum or maximum of one of the axis.

It is also possible to write optimization code to find those values of A and B which minimize the function F integrated over the time period of interest, where F is defined as:

$$F(f,g)=\int(f(t)-Ag(t)-B)^2dt,$$

where f(t) represents one response and g(t) represents another response. For example, differentiating the above expression with respect to A and B and setting the results to zero gives:

$$A=(\int dt\int fg-\int fdt\int gdt)/(\int dt\int g^2dt-\int gdt\int gdt),$$

and:

$$B=(\int fdt-A\int gdt)/\int dt.$$

This permits further automation. Let G_s be the representative well response curve and G_a be the representative annular response curve. For each sensor function f(t), f_s can be defined as the affine transform which best matches F_s (i.e., using A, B as above), and F_t is defined as the affine transform of f_s which best matches F_a (i.e. recomputing a new pair of values A, B). It is then possible to define:

$$\mu_s=\int F_sG_s(t)dt/\int G_sG_s(t)dt \text{ and}$$

$$\mu_a=\int F_aG_a(t)dt/\int G_aG_a(t)dt,$$

to give a quantitative indication of the goodness of fit. For example, one can define thresholds such that if $\mu_s$ is greater than a certain value (e.g., 0.95) then that sensor is properly identified as being dominated by the well response.

Other correlation and statistical techniques may be used to identify the proportion that a function f has of G_s and G_a.

In general, the use of $\mu_a$ may be more cautiously applied than the use of $\mu_s$, due to the reason that it is less likely for a sensor to be completely dominated by the annular fluid. In such circumstances, computational fluid dynamics may be used to predict synthetic G_a curves. Ideally, for any well configuration there should be expressions for $\mu_a$ and $\mu_s$ such that each term is positive and $\mu_a+\mu_s=1$. However, this would involve modifying the definition of G_s and G_a so that they are orthogonal to one another.

Given a parametric algorithm to determine $\mu_a$ and $\mu_s$, another step of an embodiment of a method could be to compute the synthetic completion response as being the sum of the well and annular curves computed by a forward reservoir modeling program where the same weighting is applied to the modeled results. This algorithm can also be applied to a series of wells in a reservoir.

Moreover, using techniques according to some embodiments, it is possible to compute representative flow profiles along the length of the well being monitored by the sensor array, regardless of whether or not any of the sensors are being affected by direct fluid impingement. By monitoring the flow from one well as another well is produced, it may be possible to infer the connectivity between different zones, e.g., if one well is shut-in and starts to crossflow from zone A to B, while in a different (producing) well, at the same time the sensor array detects an increase of flow from zone C, then one can infer that zones A and C have pressure continuity.

Other uses of flow-profiling can be applied, for example, such as computing the volumetric fluid produced from a zone over time so that decisions can be made regarding specifying injection wells for pressure support. In a comingled well, flow profiling at the zonal level can be important for estimating reserves as well as other economic considerations.

Instructions of software described above (including analysis software 132 of FIG. 1) are loaded for execution on a processor (such as 134 in FIG. 1). A processor can include a microprocessor, microcontroller, processor module or subsystem, programmable integrated circuit, programmable gate array, or another control or computing device.

Data and instructions are stored in respective storage devices, which are implemented as one or more computer-readable or machine-readable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. A method comprising:

deploying plural sensors into a well;

receiving measurement data regarding at least one property of the well from the sensors;

identifying, based on the measurement data, a first of the plural sensors that measures the at least one property in a region having annular fluid flow, and a second of the plural sensors that measures the at least one property in a region outside the region having the annular fluid flow; and based on the identifying, using the measurement data from a selected one or more of the plural sensors to produce a target output.

2. The method of claim 1, wherein producing the target output comprises producing a model to predict the at least one property.

3. The method of claim 2, wherein producing the model comprises producing the model having predicted values of the at least one property matched to the measurement data from the selected one or more of the plural sensors.

4. The method of claim 1, wherein producing the target output comprises generating a flow profile along the well based on the measurement data of the selected one or more of the plural sensors.

5. The method of claim 1, wherein producing the target output comprises estimating properties of a reservoir surrounding the well.

6. The method of claim 1, wherein deploying the plural sensors comprises deploying a spoolable sensor array into the well.

7. The method of claim 1, wherein the identifying is based on comparing a response of each of the plural sensors to sensor profiles.

8. The method of claim 7, wherein the identifying further comprises:

determining, from a first response profile of the measurement data from the first sensor, that the first sensor is being subjected to direct impingement by the annular fluid flow; and determining, from a second response profile of the measurement data from the second sensor, that the second sensor is measuring the at least one property due to axial flow of fluid in the well.

9. The method of claim 1, wherein the selected one or more of the multiple sensors include the second sensor but not the first sensor.

10. The method of claim 1, wherein the identifying is performed by a controller having a processor.

11. A system comprising:

a plurality of sensors for deployment in a well;

a controller configured to:

receive measurement data from the plurality of sensors;

based on analyzing the measurement data, identify a first of the sensors that is subjected to annular fluid flow and a second of the sensors that is not subjected to annular fluid flow;

based on the identifying, select one or more of the sensors; and use the measurement data from the selected one or more of the sensors to produce a target output.

12. The system of claim 11, wherein the target output includes a model to predict a property of the well.

13. The system of claim 12, wherein the controller is configured to adjust at least one parameter of the model based on the measurement data of the selected one or more sensors.

14. The system of claim 13, wherein the selected one or more sensors include the second sensor but not the first sensor.

15. The system of claim 11, wherein the target output includes one or more of a flow profile in the well and a property of a reservoir surrounding the well.

16. The system of claim 11, wherein the controller is configured to further identify another first sensor that is subjected to annular fluid flow and another second sensor that is not subjected to annular fluid flow.

17. The system of claim 11, further comprising:

a further plurality of sensors for deployment in a second well;

wherein the controller is configured to further:

receive measurement data from the further plurality of sensors;

based on analyzing the measurement data from the further plurality of sensors, identify a first of the further plurality of sensors that is subjected to annular fluid flow and a second of the further plurality of sensors that is not subjected to annular fluid flow;

based on the identifying, select one or more of the sensors further plurality of; and use the measurement data from the selected one or more of the further plurality of sensors to produce another target output.

18. The system of claim 11, wherein the plurality of sensors is part of a spoolable array of sensors.

19. An article comprising at least one non-transitory computer-readable storage medium that upon execution cause a system having a processor to:

receive measurement data regarding at least one property of a well from plural sensors deployed in the well;

identify, based on the measurement data, a first of the plural sensors that measures the at least one property in a region having annular fluid flow, and a second of the plural sensors that measures the at least one property in a region outside the region having the annular fluid flow; and based on the identifying, use the measurement data from a selected one or more of the plural sensors to produce a target output.

20. The article of claim 19, wherein producing the target output comprises producing a model to predict the at least one property.

21. The article of claim 19, wherein producing the target output comprises producing one or more of a flow profile in the well and a property of a reservoir surrounding the well.

* * * * *